US005161917A

United States Patent [19]

Papetti

[11] Patent Number: 5,161,917

[45] Date of Patent: Nov. 10, 1992

[54] METHOD OF AND AN ELEMENT FOR THE PRODUCTION OF STRUCTURES FOR CONTAINING AREAS OF GROUND

[75] Inventor: Andrea Papetti, Casalecchio di Reno, Italy

[73] Assignee: Officine Maccaferri S.p.A., Bologna, Italy

[21] Appl. No.: 592,595

[22] Filed: Oct. 4, 1990

[30] Foreign Application Priority Data

Jan. 19, 1990 [IT] Italy ..... 3311 A/90

[51] Int. Cl.[5] ..... E02D 17/18

[52] U.S. Cl. ..... 405/284; 405/258; 405/262

[58] Field of Search ..... 405/258, 262, 284, 286, 405/15, 16

[56] References Cited

U.S. PATENT DOCUMENTS

| | | | |
|---|---|---|---|
| 4,329,089 | 5/1982 | Hilfiker et al. | 405/262 |
| 4,505,621 | 3/1985 | Hilfiker et al. | 405/258 X |
| 4,856,939 | 8/1989 | Hilfiker | 405/258 X |
| 4,904,124 | 2/1990 | Egan | 405/262 |

FOREIGN PATENT DOCUMENTS

| | | | |
|---|---|---|---|
| 2303121 | 10/1976 | France | 405/258 |
| 0726859 | 3/1955 | United Kingdom . | |
| 2073281 | 10/1981 | United Kingdom | 405/284 |

*Primary Examiner*—Dennis L. Taylor

*Attorney, Agent, or Firm*—Fleit, Jacobson, Cohn, Price, Holman & Stern

[57] ABSTRACT

An element for use in producing stabilized soil structures comprises a sheet of double-twisted galvanized and plastic-coated metal mesh which has on one end a box portion made from panel of the sheet panels and folded up from the end of the sheet and an additional transverse panel fixed to the sheet.

In use a plurality of elements are superposed with the box portions providing the anterior wall of the structure and the remainder of each sheet extending back into the structure to stabilize the structure. Each element is filled and covered with fill material before a succeeding element is positioned on it.

The fold lines of panels are defined by strips introduced into the mesh of sheet during manufacture.

3 Claims, 2 Drawing Sheets

METHOD OF AND AN ELEMENT FOR THE PRODUCTION OF STRUCTURES FOR CONTAINING AREAS OF GROUND

FIELD OF THE INVENTION

The present invention relates to a method of and an element for producing artificial structures for supporting areas of ground, and also walls erected thereon.

BACKGROUND OF THE INVENTION

It is known that parallelepipedic structures made of double twisted metal mesh, known as gabions, are employed for coverings and protective structures for preventing erosion of areas of ground caused by surface water and water filtering through the ground, and for the construction of works to contain areas of ground, and for the control of landslides or the like, for river, lake, coastal, mountain, road and other defences.

Such gabions, which are resistant to corrosion and to mechanical stresses. are joined together, filled in situ with stones and soil or other particulate materials, and closed with an appropriately fixed lid of metal mesh, and constitute natural defences and reinforcements suitable for environmental restoration of degraded parts of areas at risk from landslides.

A feature common to all these structures is that they are composed of prefabricated containers in double-twisted metal mesh composed of bottom and side panels, partitions and upper closure panels. The containers are manufactured at suitable plants for the production of the metal mesh, with the appropriate operations of weaving and reinforcing the extended sheets and folding them in a manner suitable for easier transport and storage, with minimum bulk.

In use, they are filled with stones or the like, closed by the upper lid or panel, joined together and, if appropriate, placed one above the other.

A system is also known for obtaining the above mentioned results comprising special closed "mattress gabions", that is to say box-type containers of large surface area and small thickness, having multiple partitions or compartments able to cover, with no continuity, very extensive areas of land, in order to protect them from erosion.

Also known is the system of "Reinforced Earth", which employs flat curtain walls intended to support areas of ground by means of anchoring strips.

By means of the abovementioned known techniques, which entail more or less difficult and costly operations, composite structures are obtained having an outer face in the manner of a wall, more or less inclined or in stepped form, while the inner, uphill side is arduous to manufacture because of the need to produce secure anchoring points in the ground.

OBJECT OF THE INVENTION

An object of the present invention is a method for producing elements made from double-twisted metal mesh, which is galvanized and then plastic-covered, of dimensions wherein the length is greater than the width, the height of each element being low, for use in building a support and/or protective structure for covering the surface of an area of ground and having a vertical or inclined or stepped visible wall, with the maximum simplicity of use and manufacture, and capable of imparting high degrees of strength and stability to the whole of the reinforced area of ground.

SUMMARY OF THE INVENTION

According to an aspect of the present invention, in the course of producing a semi-finished element from a rectangular base sheet of galvanized and plastic-coated double-twisted metal mesh with a hexagonal grid, two zones are created at one end, along the shorter side of the rectangular sheet, into which, preferably automatically during the weaving of the mesh, metal reinforcing strips are introduced for creating or defining a hinge to facilitate the folding of the sheet at said zones, which folding is to be carried out in use.

A rectangular panel of metal mesh is joined to the base sheet, parallel to the shorter side thereof, this panel being intended in use to form an inner transverse wall of an anterior chamber created in use along the one end of the sheet, by folding the sheet about the said zones.

Other panels of square or rectangular shape, made from metal mesh, may be inserted in situ for the lateral closure of the anterior chamber, or in order to produce intermediate transverse partitions therein.

The elements described-above, which in use are filled and covered with stones and earth and are mutually superposed without the need for upper closure sheets, are capable of creating a wall, either straight or stepped, with more or less anchoring as a function of the height.

For greater structural compactness and strength, vertical metal reinforcing strips may be inserted in the vertical face, at the bottom of the slope.

In the event that earth is used to fill the anterior chamber created during use, the wall of the chamber along the surface may be covered in use with a geosynthetic material for the best containment conditions for the fill materials.

SPECIFIC DESCRIPTION

Figure 1:
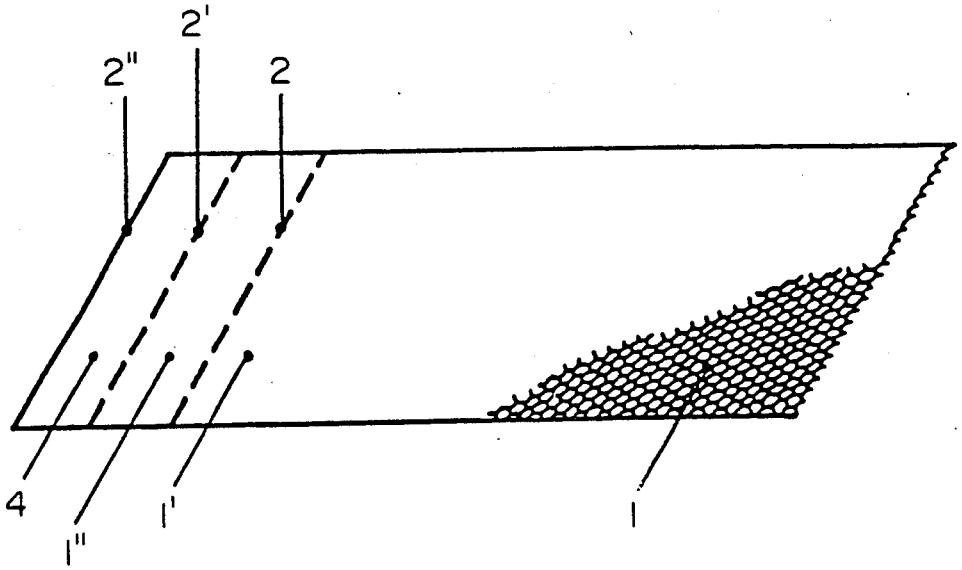
FIG. 1 illustrates an embodiment of a mesh element in the construction phase.
Figure 2:
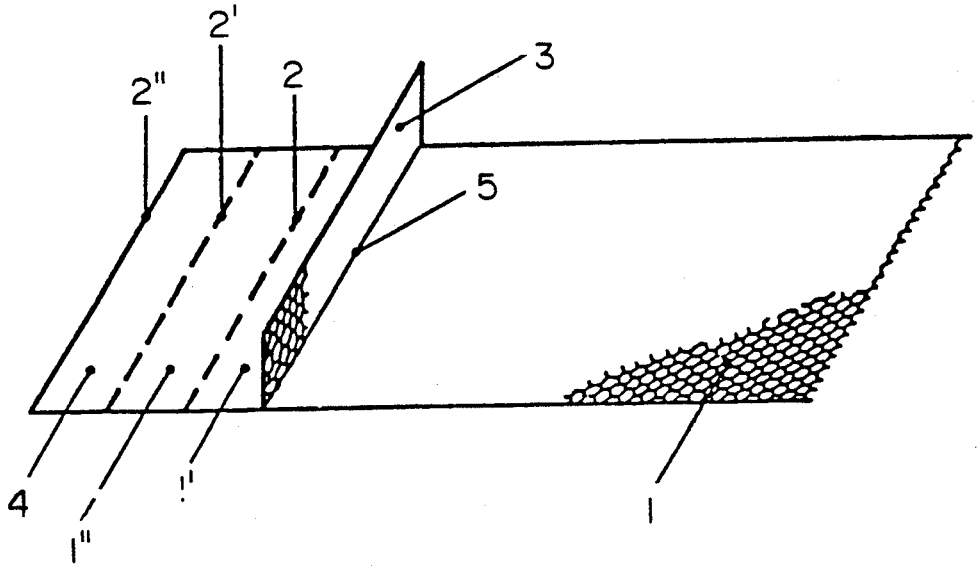
FIG. 2 illustrates the attachment of an inner transverse wall to the element of FIG. 1.

A rectangular base sheet 1 is made of a hexagonal mesh structure formed by double-twisted mesh, preferably made of galvanised and plastic-coated metal wire. The sheet 1 comprises panels 1″ and 4 defined by the insertion, along lines or zones intended for folding 2 and 2′ and optionally along connection 2″, of transverse metal reinforcing strips directly in the sheet during manufacture of the sheet. The strips may have a circular section and may be galvanised and plastic-coated.

Further in the course of manufacture, a panel 3 is automatically connected to panel 1 in zone 5, e.g. by means of metal wire which is threaded helically through the mesh of the panels 1 and 3, thereby defining a further panel 1′.

The panels 1′ and 1″ of the sheet 1 may in use be covered with a geosynthetic material in the case where an earth fill is used.

The formation of the element proceeds by folding up the panel 1″ relative to panel 1′, the panel 3 and the panel 4 to create at one end of sheet 1 an anterior chamber or box portion, which operation is performed during use. The anterior box portion is arranged at the front of the structure being made, with the remainder of the panel 1 extending back into the structure. The longitudinal dimension of the remainder of panel 1 may depend on and be varied in accordance with the vertical height of the ultimate structure to provide the required stabilisation of the structure.

In use the box portion of the element is filled with the particulate fill before panel 4 is folded over the top and the remainder of sheet 1 is covered with the fill material up to the level of the top of the box portion.

Figure 3:
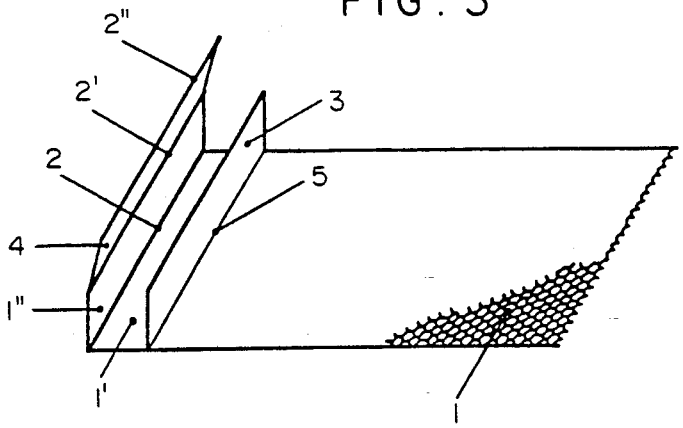
FIG. 3 illustrates the formation, in the course of use, of the anterior chamber or box portion of the element.
Figure 4A:
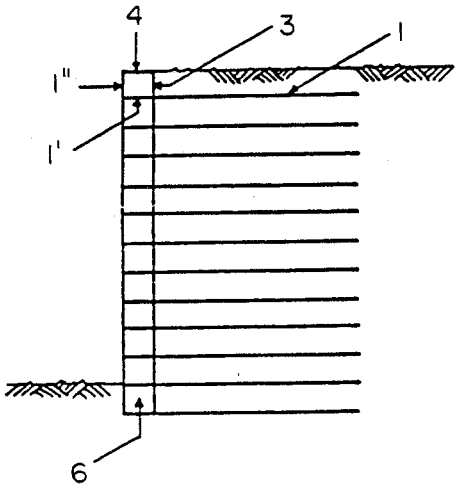
FIG. 4 illustrates a typical use of the elements to form a vertical wall (FIG. 4*a*) or a stepped wall (FIG. 4*b*)
Figure 4B:
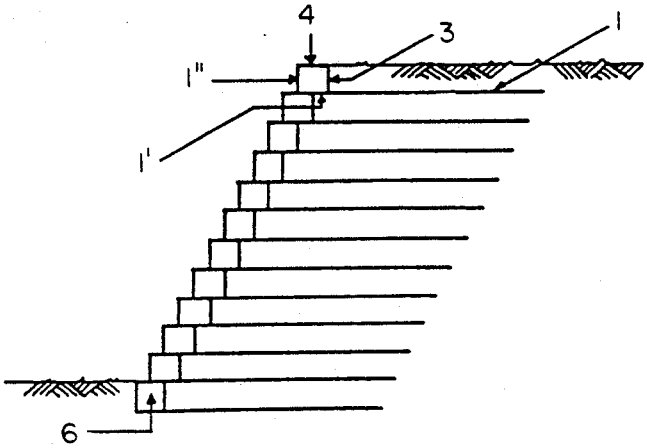
Figure 5:
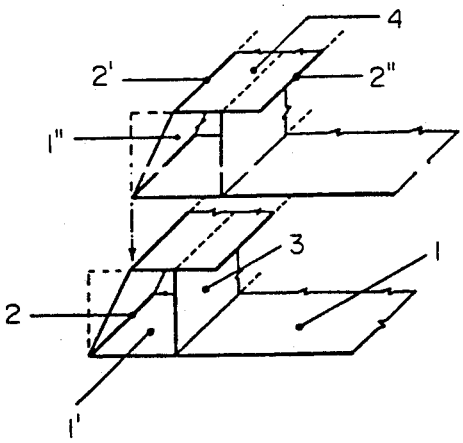
FIG. 5 illustrates the detail of the formation of an inclined wall.

After one element has been created, filled and covered with particulate fill material, e.g. stony or earthy material, succeeding elements are appropriately superposed on each lower element 6, erected, filled and covered, in order to form a structure which may have a smooth vertical outer wall, as in FIG. 4*a*, or a stepped wall, as in FIG. 4*b*. Alternatively the wall may be inclined and smooth, as in FIG. 5, which is obtained by appropriate inclination of the plane formed by the panels 1″ in FIG. 3 and positioning of the plane of the panel 4 beyond the panel 3, the edge 2 of each superposed element coinciding with the edge 2′ of the lower element, so that a single inclined plane is obtained which is formed by the panels 1″.

To provide the stepped wall (FIG. 4*b*), each superposed element is appropriately and equally offset relative to the underlying element.

Depending on the width of the structure to be made, a plurality of elements may be arranged side-by-side in a layer, the elements being then erected, filled and covered. Succeeding layers of elements are then placed in position, erected, filled and covered. Adjacent elements in adjacent layers may be laterally aligned or offset. The elements in each layer may be connected along juxtaposed edges e.g. with metal wire or clips.

The present invention, which is illustrated and described diagrammatically, by way of example, is to be understood as being capable of extension to all those accessory alternative embodiments in respect of shape, dimensions and materials which, as such, enter into the scope thereof, it being possible for the individual techniques to be replaced by other equivalent techniques without thereby departing from the scope of protection of the claims which follow.

I claim:

1. A method of producing an element for use in a structure for covering the surface of an area of ground and supported by elements made from double-twisted mesh, comprising the steps of:

providing a rectangular base sheet of galvanized and plastic-coated, double-twisted metal mesh, the base sheet having base sheet panels capable of being folded in the transverse direction of the base sheet;

inserting into the metal mesh of the base sheet strips for defining fold lines for folding the panels of the sheet; and mechanically connecting and fixing a transverse containing panel to the base sheet;

the transverse panel being extended upwardly in use from the base sheet and the base sheet panels being folded about said fold lines to create with the transverse panel an anterior box portion.

2. The method defined in claim 1, wherein at least some walls of the anterior box portion are covered with a geosynthetic material in the event of filling with earth.

3. An element for use in a structure for covering the surface of an area of ground comprising a rectangular base sheet made of metal mesh having transversely foldable base sheet panels at one end of the sheet and a transverse containing panel attached to the base sheet adjacent the base sheet panels, said containing panel and said base sheet panels being intended to be folded in the transverse direction of the sheet during use to form a box portion for forming the anterior edge of a vertical or inclined wall obtained by means of successive superposition of like elements after filling them with inert stony or earthy materials, the element including metal strips inserted in the base sheet to form fold lines between the base sheet panels.

* * * * *